United States Patent [19]

Faiella

[11] 4,414,760

[45] Nov. 15, 1983

[54] AIR-CUSHION INSOLE

[75] Inventor: James Faiella, West Palm Beach, Fla.

[73] Assignee: Kaepa, Inc., San Antonio, Tex.

[21] Appl. No.: 369,133

[22] Filed: Apr. 16, 1982

[51] Int. Cl.[3] ..... A43B 13/40; A43B 13/20

[52] U.S. Cl. ..... 36/29; 36/28; 36/43

[58] Field of Search ..... 36/28, 29, 31, 43, 44

[56] References Cited

U.S. PATENT DOCUMENTS

| | | | |
|---|---|---|---|
| 1,069,001 | 7/1913 | Guy | 36/29 |
| 3,225,463 | 12/1965 | Burnham | 36/29 |
| 4,224,746 | 9/1980 | Kim | 36/44 |

*Primary Examiner*—Werner H. Schroeder
*Assistant Examiner*—Steven N. Meyers
*Attorney, Agent, or Firm*—Cohn, Powell & Hind

[57] ABSTRACT

An air-cushion insole for a shoe provided by an envelope having a sole portion with a sole compartment, and a heel portion with a heel compartment separate from the sole compartment. A first valve operatively interconnects the sole compartment with ambience. A second valve operatively interconnects the sole and heel compartments. The heel portion includes a first port operatively interconnecting the heel compartment with ambience. Elements that are compressible and expandable under pressure are located in the sole and heel compartments. An air passage operatively interconnects the second valve with a second port formed in the sole compartment. Upon compression of the sole compartment and its compressible element, air is exhausted from the sole compartment through the second port and into the air passage, and thence through the second valve into the heel compartment. Upon compression of the heel compartment and its compressible element, the second valve is closed and the air is exhausted through the first port to ambience. At the same time, upon relief of compression from the sole compartment and its expandable element, air is drawn through the first valve from ambience into the sole compartment. Upon relief of compression from the heel compartment and its expandable element, air is drawn from ambience through the first port and into the heel compartment.

10 Claims, 4 Drawing Figures

AIR-CUSHION INSOLE

BACKGROUND OF THE INVENTION

This invention relates generally to an improved insole for a shoe, and more particularly to improvements in an air-cushion insole that absorbs shock and also absorbs and expels heat.

In using a shoe with the heretofore conventional type of insole, the foot engaged the insole during walking and running under sufficient pressure at times to cause trauma to the foot and body of the wearer. Moreover, because the uppers of most shoes enclose and press the foot down on the insole, heat, including body heat from the foot was trapped primarily between the foot sole and the shoe insole, thereby creating discomfort to the wearer.

SUMMARY OF THE INVENTION

When the present air-cushion insole is utilized in a shoe, there is considerably less possibility of trauma to the foot and body of the wearer because the insole absorbs the shock of the foot on the insole during walking and running. Moreover, the air-cushion insole constantly changes the environment with an air flow that absorbs and expels heat, thereby effectively cooling the area between the foot sole and the insole, and thereby providing comfort to the wearer.

Moreover, the air-cushion insole provides a stable platform that will configure itself constantly to the foot and adjust for the wearing of the shoe sole so that the foot remains in its natural position.

The present air-cushion insole includes an envelope having a sole portion with a sole compartment, and a heel portion with a heel compartment separate from the sole compartment. A first valve means operatively interconnects the sole compartment with ambience, the first valve means closing upon compression of the sole portion, and opening upon relief of compression of the sole portion to admit air into the sole compartment. Means operatively interconnects the sole compartment and the heel compartment, the means including a second valve means closing upon compression of the heel portion, and opening upon compression of the sole portion to admit air into the heel compartment from the sole compartment. The heel portion provides a first port operatively interconnecting the heel compartment with ambience, the first port exhausting air from the heel compartment upon compression of the heel portion, and admitting air into the heel compartment upon relief of compression of the heel portion.

In one aspect of the air-cushion insole, the means operatively interconnecting the sole compartment and the heel compartment includes an air passage that is operatively interconnected with the heel compartment by the second valve means.

In another aspect of the air-cushion insole, the means operatively interconnecting the sole compartment and the heel compartment includes a second port operatively interconnecting the sole compartment with the air passage, the second port exhausting air from the sole compartment to the air passage upon compression of the sole portion.

In still another aspect of the air-cushion insole, the means operatively interconnecting the sole compartment and heel compartment includes a sheet extending between the sole portion and heel portion, the air passage being provided by the enclosure between the sheet and the sole and heel portion.

In another aspect of the air-cushion insole, a first element, formed of a material that is compressible and expandable under pressure such as foam, is located in the sole compartment, and a similar second element is located in the heel compartment. The first valve means closes upon compression of the sole portion and its compressible first element, and opens upon expansion of the sole portion and its expandable first element to admit air into the sole compartment. The second valve means closes upon compression of the heel portion and its compressible second element, and opens upon compression of the sole portion and its compressible first element to admit air into the heel compartment from the sole compartment. The first port exhausts air from and admits air into the heel compartment upon compression and expansion respectively of the heel portion and its compressible and expandable second element.

DESCRIPTION OF THE PREFERRED EMBODIMENT

Figure 2:
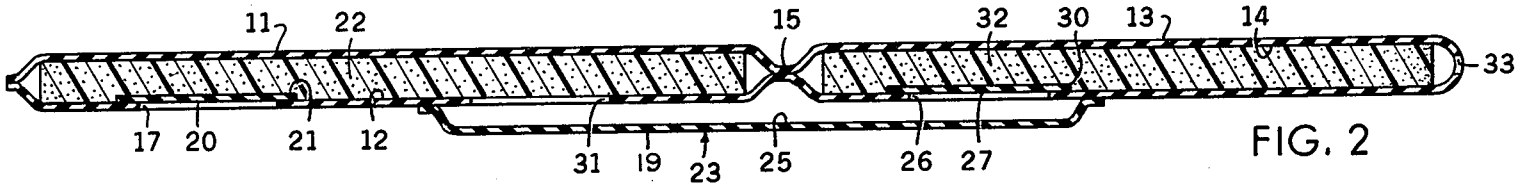
FIG. 2 is a cross-section of the insole as taken on staggered line 2—2 of FIG. 1, illustrating the heel and sole compartment expanded.

Referring now by characters of reference to the drawing, it will be understood that the air-cushion insole includes an envelope, generally indicated by 10, formed preferably of a six mil flexible plastic material. The envelope 10 includes a sole portion 11 having a sole compartment 12. Further, the envelope 10 includes a heel portion 13 having a heel compartment 14 that is separate from the sole compartment 12. The sole and heel portions 11 and 13 are separated by an intervening transverse seal 15.

A first valve means, referred to by 16, operatively interconnects the sole compartment 12 with ambience. The first valve means 16 closes upon compression of the sole portion 11, and opens upon relief of compression of the sole portion 11 to admit air into the sole compartment 12. More particularly, the first valve means 16 includes a valve port 17 formed in the bottom of the sole portion 11, and operatively interconnecting the sole compartment 12 with ambience. A check valve flap 20, preferably made of a flexible plastic material, is located in the sole compartment 12, and has one edge 21 secured to the bottom of the sole portion 11 adjacent to the margin of valve port 17, the valve flap 20 overlying and covering the valve port 17.

Also located in the sole compartment 12 is a first element 22, formed of a material that is compressible and expandable under pressure. Preferably, this first element is made of a 10 mil thick, silicic foam. The first valve means 16 closes upon compression of the sole portion 11 and its first element 22, and opens upon expansion of the sole portion 11 and the first element 22 to admit air from ambience into the sole compartment 12.

Means, generally indicated by 23, operatively interconnects the sole compartment 12 with the heel compartment 14. This means 23 includes a second valve means, referred to by 24, that closes upon compression of the heel portion 13, and opens upon compression of the sole portion 11 to admit air into the heel compartment 14 from the sole compartment 12.

The means 23 operatively interconnecting the sole compartment 12 and heel compartment 14 includes a sheet 19 extending between and attached to the bottom of the sole and heel portions 11 and 13. An air passage 25 is provided between the sheet 19 and the enclosed bottom surfaces of the sole and heel portions 11 and 13.

The second valve means 24 operatively interconnects the air passage 25 with the heel compartment 14. More particularly, the second valve means 24 includes a valve port 26 formed in the bottom of the heel portion 13, the valve port 26 placing the air passage 25 in communication with the heel compartment 14. Located in the heel compartment 14 is a check valve flap 27 formed of a flexible plastic. The valve flap 27 has one edge 30 secured to the bottom of heel portion 13 adjacent to the margin of valve port 26, the valve flap 27 overlying and covering the valve port 26.

The means 23 operatively interconnecting the sole and heel compartments 12 and 14 also includes a second port 31 formed on the bottom of the sole portion 11, the second port 31 operatively interconnecting the sole compartment 12 with the air passage 25. The second port 31 exhausts air from the sole compartment 12 to the air passage 25 upon compression of the sole portion 11.

A second element 32, formed of a material that is compressible and expandable under pressure, is located in the heel compartment 14. Preferably, the second element 32 is formed of a 10 mill thick, silicic foam.

The second valve means 24 closes upon compression of the heel portion 13 and its compressible second element 32, and opens upon compression of the sole portion 11 and its compressible first element 22 to admit air into the heel compartment 14 from the sole compartment 12. The second port 31 exhausts air from the sole compartment 12 to the air passage 25 upon compression of the sole portion 11 and its compressible first element 22.

The heel portion 13 is provided with a first port 33 that operatively interconnects the heel compartment 14 with ambience. The first port 33 exhausts air from the heel compartment 14 upon compression of the heel portion 13, and admits air into the heel compartment 14 upon relief of compression of the heel portion 13. More particularly, the first port 33 exhausts air from and admits air into the heel compartment 14 upon compression and expansion respectively of the heel portion 13 and its compressible and expandable second element 32.

It is thought that the operation and function of the air-cushion insole has become apparent from the foregoing detailed description of parts, but for completeness of disclosure, the function of the insole will be briefly described. It will be assumed that in its initial state, the sole and heel portions 11 and 13 and their respective foam first and second elements 22 and 32 are expanded, as is best shown in FIG. 2. It will also be understood that when the foot engages the upper side of the insole during normal walking or running action, the foot will exert pressure on the sole portion 11 while relieving pressure from the heel portion 13, and alternately will exert pressure on the heel portion 13 while relieving pressure from the sole portion 11.

Figure 3:
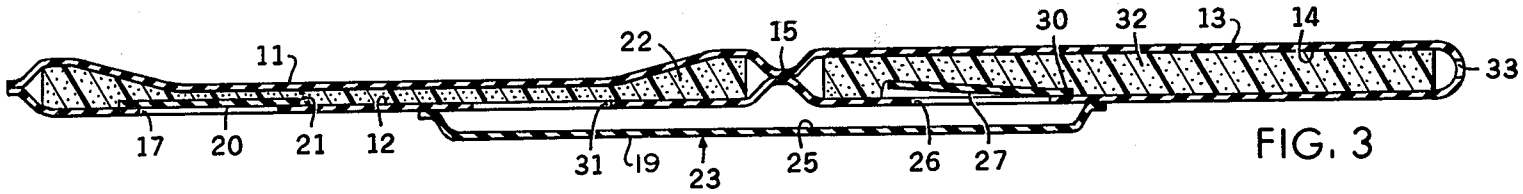
FIG. 3 is a cross-section of the insole, similar to FIG. 2, but illustrating the position of the component parts with the sole portion compressed.

From FIG. 3, it is seen that when the sole portion 11 and its compressible foam, first element 22 are compressed, the check flap 20 effectively closes the valve port 17 to close the first valve means 16. The air in the sole compartment 12 and in the foam, first element 22 passes through the second port 31 into the air passage 25. As a result, the check valve flap 27 lifts from and opens the valve port 26 to open the second valve means 24 to admit air into the heel compartment 14 from the air passage 25.

Figure 4:
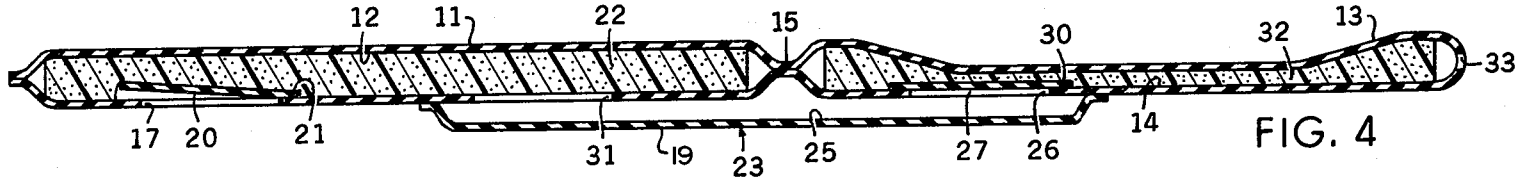
FIG. 4 is a cross-section of the insole, similar to FIG. 2, but illustrating the position of the component parts with the heel portion compressed.
Figure 1:
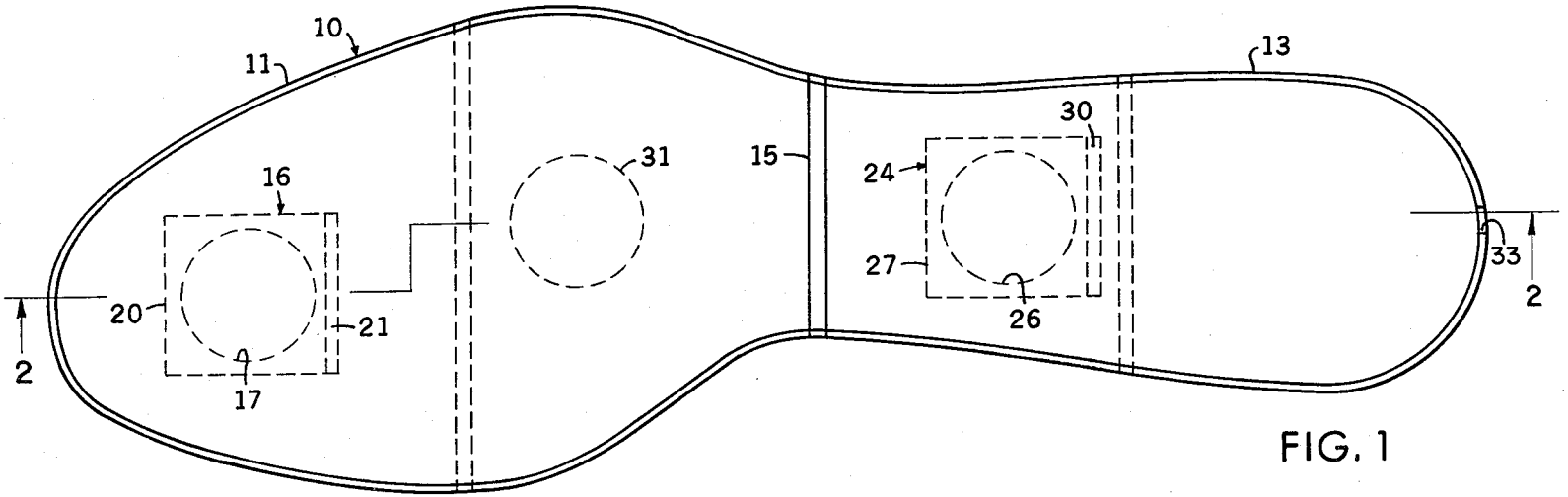
FIG. 1 is a top plan view of the air-cushioned insole.

Subsequently, when the heel portion 13 and its foam, second element 32 is compressed, as shown in FIG. 4, the pressure in the heel compartment 14 causes the check valve flap 27 to effectively close the valve port 26, and thereby close the second valve means 24. The air in the heel compartment 14 and the compressible foam, second element 32 is then exhausted through the first port 33 to ambience. The first port 33 is restricted and its size predetermined to control the rate that air is exhausted from and admitted into the heel compartment 14.

When the heel portion 13 is compressed as described above, compression is relieved from the sole portion 11 and its expandable foam, first element 22. Upon this relief of compression, the check valve flap 20 lifts from and opens the associated valve port 17 to open the first valve means 16. Air is then admitted into the sole compartment 12 from ambience, and the sole portion 11 and its expandable foam, first element 22 are expanded.

Conversely, when the sole portion 11 is compressed, the heel portion 13 and is expandable foam, second element 32 are relieved from compression. Under these circumstances, the second valve means 24 opens to admit air from the sole compartment 12 into the heel compartment 14 as previously described. However, when the compression of the sole portion 11 is removed, and the heel portion 13 and its expandable foam, second element 32 are relieved from compression, air is admitted from ambience through the first port 33 and into the heel compartment 14 to expand the heel portion 13 and the expandable foam, second element 32.

The function of the air-cushion insole assists in absorbing shock, and also contracts and expands responsive to pressure to cause the insole to breathe, i.e., drawing in and exhausting air to ambience to dissipate heat from the insole and from around the foot.

We claim as our invention:

1. An air-cushion insole for a shoe, comprising:

(a) an envelope including:

1. a sole portion having a sole compartment, and
2. a heel portion having a heel compartment separate from the sole compartment, (b) a first valve means including a valve port operatively interconnecting the sole compartment with ambience, a check valve flap over the valve port, the valve flap of the first valve means closing the valve port upon compression of the sole portion, and opening the valve port upon relief of compression of the sole portion to admit air into the sole compartment, a second port in the sole portion operatively interconnecting the sole compartment, (d) a second valve means including a valve port and a check valve flap over the valve port, the check valve flap closing the valve port upon compression of the heel portion, and opening the valve port upon compression of the sole portion to admit air into the heel compartment from the sole compartment through the said second port, and (e) the heel portion providing a first port operatively operatively interconnecting the heel compartment with ambience, the first port exhausting air from the heel compartment upon compression of the heel portion, and admitting air into the heel compartment upon relief of compression of the heel portion.

2. An air-cushion insole for a shoe as defined in claim 1, in which:

(f) the said second port in the sole portion operatively interconnecting the sole compartment and the heel compartment through the second valve means.

3. An air-cushion insole for a shoe, comprising:

(a) an envelope including:

1. a sole portion having a sole compartment, and
2. a heel portion having a heel compartment separate from the sole compartment, (b) a first valve means including a valve port operatively interconnecting the sole compartment with ambience, a check valve flap over the valve port, the valve flap of the first valve means closing the valve port upon compression of the sole portion, and opening the valve port upon relief of compression of the sole portion to admit air into the sole compartment, (c) a second port in the sole portion operatively interconnecting the sole compartment and the heel compartment, (d) a second valve means including a valve port and a check valve flap over the valve port, the check valve flap closing the valve port upon compression of the heel portion, and opening the valve port upon compression of the sole portion to admit air into the heel compartment from the sole compartment through the second port, (e) the heel portion providing a first port operatively interconnecting the heel compartment with ambience, the first port exhausting air from the heel compartment upon compression of the heel portion, and admitting air into the heel compartment upon relief of compression of the heel portion, (f) the said second port in the sole portion operatively interconnecting the sole compartment and the heel compartment through the second valve means, and (g) means providing an air passage operatively interconnecting the said second port with the second valve means, the second port exhausting air from the sole compartment to the air passage upon compression of the sole portion.

4. An air-cushion insole for a shoe as defined in claim 3, in which:

(h) the air passage is provided between a sheet extending between the sole and heel portions.

5. An air-cushion insole for a shoe as defined in claim 1, in which:

(f) a first element, formed of a material that is compressible and expandable under pressure, is located in the sole compartment, (g) a second element, formed of a material that is compressible and expandable under pressure, is located in the heel compartment, (h) the valve flap of the first valve means closes the valve port upon compression of the first element, and opens the valve port upon expansion of the first element to admit air into the sole compartment, (i) the valve flap of the second valve means closes the valve port upon compression of the second element, and opens the valve port upon compression of the first element to admit air into the heel compartment from the sole compartment, and (j) the said first port exhausts air from and admits air into the heel compartment upon compression and expansion respectively of the second element.

6. An air-cushion insole for a shoe as defined in claim 5, in which:

(j) the material of the first and second elements is a foam.

7. An air-cushion insole for a shoe as defined in claim 5, in which:

(k) the said second port in the sole portion operatively interconnecting the sole compartment and the heel compartment through the second valve means.

8. An air-cushion insole for a shoe, comprising:

(a) an envelope including:

1. a sole portion having a sole compartment, and
2. a heel portion having a heel compartment separate from the cole compartment, (b) a first valve means including a valve port operatively interconnecting the sole compartment with ambience, a check valve flap over the valve port, the valve flap of the first valve means closing the valve port upon compression of the sole portion, and opening the valve port upon relief of compression of the sole portion to admit air into the sole compartment, (c) a second port in the sole portion operatively interconnecting the sole compartment and the heel compartment, (d) a second valve means including a valve port and a check valve flap over the valve port, the check valve flap closing the valve port upon compression of the heel portion, and opening the valve port upon compression of the sole portion to admit air into the heel compartment from the sole compartment through the second port, (e) the heel portion providing a first port operatively interconnecting the heel compartment with ambience, the first port exhausting air from the heel compartment upon compression of the heel portion, and admitting air into the heel compartment upon relief of compression of the heel portion, (f) a first element, formed of a material that is compressible and expandable under pressure, located in the sole compartment, (g) a second element, formed of a material that is compressible and expandable under pressure, located in the heel compartment, (h) the valve flap of the first valve means closing the valve port upon compression of the first element, and opening the valve port upon expansion of the first element to admit air into the sole compartment, (i) the valve flap of the second valve means closing the valve port upon compression of the second element, and opening the valve port upon compression of the first element to admit air into the heel compartment from the sole compartment, (j) the said first port exhausting air from and admitting air into the heel compartment upon compression and expansion respectively of the second element (k) the said second port in the sole portion operatively interconnecting the sole compartment and the heel compartment through the second valve means, and (l) means providing an air passage operatively interconnecting the said second port with the second valve means, the second port exhausting air from the sole compartment to the air passage upon compression of the first element.

9. An air-cushion insole for a shoe as defined in claim 8, in which:

(m) the air passage is provided between a sheet extending between the sole and heel portions.

10. An air-cushion insole for a shoe, comprising:

(a) an envelope including:

1. a sole portion having a sole compartment, and
2. a heel portion having a heel compartment separate from the sole compartment, (b) a first valve means including a valve port operatively interconnecting the sole compartment with ambience, a check valve flap over the valve port, the valve flap of the first valve means closing the valve port upon compression of the sole portion, and opening the valve port upon relief of compression of the sole portion to admit air into the sole compartment, (c) a second port in the sole portion operatively interconnecting the sole compartment and the heel compartment, (d) a second valve means including a valve port and a check valve flap over the valve port, the check valve flap closing the valve port upon compression of the heel portion, and opening the valve port upon compression of the sole portion to admit air into the heel compartment from the sole compartment through the second port, (e) the heel portion providing a first port operatively interconnecting the heel compartment with ambience, the first port exhausting air from the heel compartment upon compression of the heel portion, and admitting air into the heel compartment upon relief of compression of the heel portion, (f) a first foam element that is compressible and expandable under pressure located in the sole compartment, (g) a second foam element that is compressible and expandable under pressure located in the heel compartment (h) valve port of the first valve means is provided in the bottom of the sole portion, and (i) a sheet extends between the sole and heel portions at the bottom of the insole, the sheet and the sole and heel portions providing an air passage therebetween, (j) the second port is in the bottom of the sole portion operatively interconnecting the sole compartment and the air passage, the second port exhausting air from the sole compartment to the air passage upon compression of the first foam element, (k) the valve port of the second valve means is provided in the bottom of the heel portion, and interconnects the air passage with the heel compartment, and (l) the check valve flap of the second valve means operatively closing the valve port upon compression of the second foam element, and opening the valve port upon introduction of air into the air passage when the first foam element is compressed.

* * * * *

UNITED STATES PATENT AND TRADEMARK OFFICE

CERTIFICATE OF CORRECTION

PATENT NO. : 4,414,760

DATED : November 15, 1983

INVENTOR(S) : James Faiella

It is certified that error appears in the above-identified patent and that said Letters Patent are hereby corrected as shown below:

Column 4: Line 45, delete "we" and insert --I--.
Line 45, delete "our" and insert --my--.
Line 60, before "a" insert --(c)--.
Line 61, after "compartment" insert --and the heel compartment--.

Column 5: Line 2, delete "operatively".

Column 6: Line 13, delete "interconnecting" and insert --interconnects--.
Line 20, delete "cole" and insert --sole--.

Column 8: Line 12, after "partment" insert --,--.
Line 13, after "(h)" insert --the--.
Line 14, delete "and (i) a sheet ex-"
Line 15, delete "tends" and insert --(i) a sheet extends--.

Signed and Sealed this

Seventh Day of February 1984

[SEAL]

Attest:

GERALD J. MOSSINGHOFF

Attesting Officer

Commissioner of Patents and Trademarks